United States Patent [19]

Bailey

[11] Patent Number: 4,846,352

[45] Date of Patent: Jul. 11, 1989

[54] SCREEN CLAMP

[75] Inventor: Marshall G. Bailey, Banchory, Scotland

[73] Assignee: Thule United Limited, Aberdeen, Scotland

[21] Appl. No.: 125,752

[22] Filed: Nov. 20, 1987

Related U.S. Application Data

[63] Continuation of Ser. No. 871,755, Jun. 9, 1986, abandoned.

[30] Foreign Application Priority Data

Jun. 13, 1985 [GB] United Kingdom ..... 8514983

[51] Int. Cl.[4] ..... B07B 1/28

[52] U.S. Cl. ..... 209/399; 209/403; 209/405

[58] Field of Search ..... 209/399, 403, 405; 210/324, 350, 384, 388, 495, 499

[56] References Cited

U.S. PATENT DOCUMENTS

| | | | |
|---|---|---|---|
| 3,176,843 | 1/1962 | Hoskins et al. | 209/403 |
| 3,256,992 | 6/1966 | Eiling | 210/251 |
| 3,968,033 | 7/1976 | Illeman et al. | 209/403 |
| 4,082,657 | 4/1978 | Gage | 209/405 |
| 4,568,455 | 2/1986 | Huber et al. | 209/405 |
| 4,582,597 | 4/1986 | Huber | 209/403 |
| 4,627,541 | 12/1986 | Johnson | 209/394 |
| 4,744,898 | 5/1988 | Bailey | 209/403 X |

FOREIGN PATENT DOCUMENTS

| | | | |
|---|---|---|---|
| 1326260 | 3/1963 | France | 209/403 |
| 839611 | 6/1981 | U.S.S.R. | 209/405 |

*Primary Examiner*—Robert B. Reeves
*Assistant Examiner*—Donald T. Hajec
*Attorney, Agent, or Firm*—Oblon, Fisher, Spivak, McClelland & Maier

[57] ABSTRACT

A basket 1 of vibratory screening apparatus comprises inflatable elastomeric member 3 positioned to overlie a part of a screen member 5, 7 mounted in the basket. Inflation of the inflatable elastomeric member 3 causes it to press against a screen frame 7 of the screen member, clamping it against a support 9, 29 of the basket 1. Preferably the inflatable elastomeric member 3 is deflatable and a reservoir 19 may be provided for vented inflation fluid. The screen member may be pre- or post-tensioned. The basket 1 may comprise supports 29 and inflatable elastomeric member 3 positioned to press against parts of the screen member remote from its periphery.

11 Claims, 2 Drawing Sheets

SCREEN CLAMP

This application is a continuation of application Ser. No. 06/871,755 filed on June 9, 1986, now abandoned.

FIELD OF INVENTION

This invention concerns the mounting of screens in vibratory apparatus such as is used for the sifting of mud and the like materials derived from oil-well drilling.

BACKGROUND OF THE INVENTION

It is known to mount a screen in a frame and mount the latter in a basket mounted within a machine housing and adapted to be oscillated or otherwise vibrated as by a cam drive mechanism.

For servicing and replacement it is desirable to be able to remove the screen and its associated frame where provided from the machine and to this end the latter is adapted to be slid into and out of the basket and clamping means is provided to hold the frame and screen in position. Clearly it is desirable that the clamping shall be effected as quickly as possible to reduce down time.

It is known to make the frame for the screen inflatable, in order to provide a means for tensioning the screen within the vibratory apparatus. In EP-A-0130744 there is proposed a screen having an inflatable screen frame which on inflation both tensions the screen and clamps it in position in the screening device. However, this arrangement is of limited application. Since the inflation of the screen frame both clamps the screen in position and tensions it, the arrangement cannot be used with screens which are to be tensioned in some other manner such as by a tensioning clip or screw on the basket of the vibratory apparatus or which are pre-tensioned within a rigid frame. Additionally, since the same act of inflation both clamps the screen and tensions it, the clamping force and the tensioning force cannot be controlled independently. Finally, it is necessary for each screen to be associated with its own respective clamping arrangement, since this is incorporated in the screen frame, even when the screen is not mounted within a vibratory screening apparatus, and thus it is necessary to fabricate as many inflatable frames as there are screens.

It is therefore an object of the present invention to provide an improved clamping mechanism.

SUMMARY OF THE INVENTION

In accordance with the present invention in a first aspect there is provided vibratory screening apparatus in which a screen member may be mounted, the apparatus having inflatable means located within it to overlie at least a part of a screen member mounted in the apparatus so that inflation of the inflatable means clamps the screen member in place.

In accordance with the present invention in a second aspect there is provided a method of clamping a screen member in place in a vibratory screening apparatus, the apparatus comprising inflatable means located within it to overlie at least a part of a screen member mounted in the apparatus, in which the inflatable means is inflated when the screen member is in place so as to clamp the screen member.

The inflatable means may comprise one or more inflatable members.

Preferably the inflatable means overlies at least a part of the edge region of the screen member.

The screen member may or may not include a screen frame in which the actual screen is located. However, in normal use a screen member comprising a screen in a frame will be used and the screen member designed or selected so that the inflatable means of the vibratory screening apparatus acts on the screen frame and not on the screen itself.

Normally, the inflatable means will be located within a basket of the vibratory screening apparatus in which basket the screen member may be mounted.

The screen may be inserted into the apparatus untensioned, and be tensioned subsequently (post-tensioning) against the body of the vibratory apparatus. Alternatively, if the screen is located in a frame, the screen may be tensioned against the screen frame, and this may take the form of pre-tensioning the screen against the screen frame before insertion into the vibratory apparatus. Embodiments of the present invention may be used with pretensioned screens or post-tensioned screens. Our earlier applications GB-A-2161715 and GB-A-2162091 disclose permanently pre-tensioned screens with which embodiments of the present invention may be used.

Preferably means is provided to enable the inflated member to be deflated to enable the screen member to be withdrawn for servicing or replacement.

The inflatable member may for example be in the form of an elastomeric stocking which is secured to edge regions of the screen member supporting structure of the vibratory apparatus so as to overlie the peripheral region of the screen member. When it is inflated and enlarged the increased cross-section of the stocking pushes firmly against the upper (or lower) surface of the frame and screen and clamps it securely in position against the underside (or topside) supporting structure.

Conveniently the stocking extends around at least three sides of the frame and preferably also the fourth side.

Means for inflating the stocking or other deivce may be mounted on and from an integral part of the overall apparatus or a pressurized fluid or airline connection may be provided on the stocking or connected to the stocking so as to enable the latter to be inflated from a separate air supply or hydraulic fluid supply.

Whichever arrangement is used there is preferably also provided a venting device by which the pressure in the stocking can be relieved. Where the inflating fluid is a hydraulic oil or other liquid the venting device preferably communicates with a reservoir of the liquid so that as the latter is exhausted from the stocking the oil can be returned to a common reservoir and is thereby saved.

BRIEF DESCRIPTION OF THE DRAWINGS

Embodiments of the present invention, given by way of nonlimitative examples, will now be described with reference to the accompanying drawings, in which.

DETAILED DESCRIPTION OF THE DRAWINGS

Figure 1:
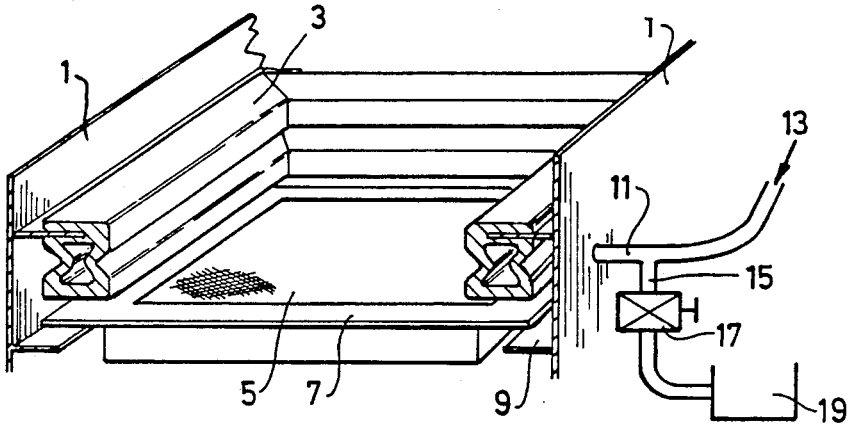
FIG. 1 is a schematic sectional view of a first embodiment of the present invention.

FIG. 1 shows a basket 1 of a vibratory screening apparatus in which is located an expansible elastomeric member 3. A removable screen member comprising a screen 5 and a screen frame 7 is mounted within the basket 1 and supported by lateral projections 9 of the basket.

The lateral projections 9 support the screen member immediately below the elastomeric member 3. The elastomeric member is secured to the basket at its upper side, so that inflation of the elastomeric member causes it to expand downwardly and press the screen member against the lateral projections 9 so as to hold the screen member firmly in place in the basket 1. The vertical spacing between members has been exaggerated in FIG. 1 (and also in FIG. 2) for clarity.

The elastomeric member 3 extends around the periphery only of the area defined by the basket 1. The screen frame 7 forms the periphery of the screen member, and when the elastomeric member 3 is inflated it presses against the screen frame 7 only, and does not contact the screen 5.

A supply line 11 is provided in order to convey pressurised air, hydraulic oil or other suitable medium, to the elastomeric member 3, as indicated by the arrow 13, in order to inflate it. The supply line 11 has a branch 15 leading to a pressure relief valve 17, whereby the inflation pressure in the inflatable member may be relieved and the member may be deflated. This releases the clamping effect on the screen member, so that it may be removed for replacement or cleaning.

When the inflation medium for the elastomeric member 3 is not air, it may be desirable to collect it as it is exhausted from the member 3 through the valve 17. Accordingly, the branch line 15 is shown in FIG. 1 to extend beyond the valve 17 to a reservoir 19 where vented inflation fluid may be collected.

Typically, the embodiment of FIG. 1 will be used with screens which are pre-tensioned against their screen frames.

Figure 2:
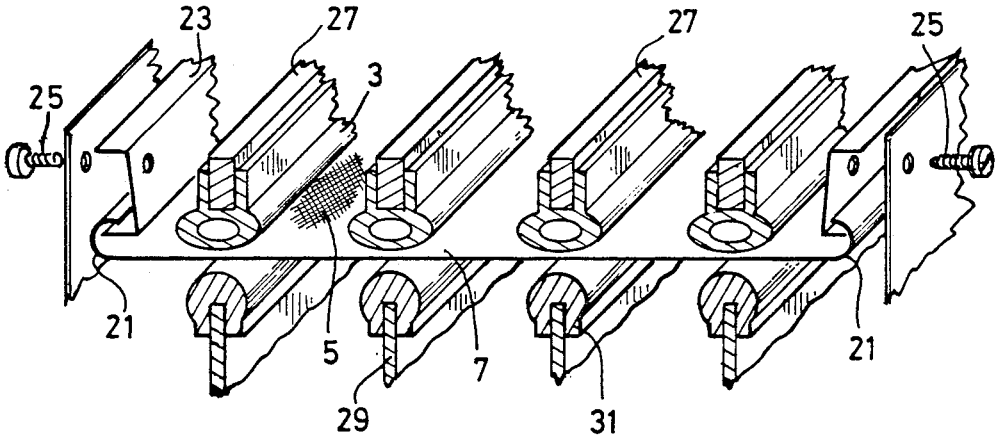
FIG. 2 is a schematic sectional view of a second embodiment of the present invention.

FIG. 2 shows another embodiment of the present invention being used with a screen member in which the screen is tensioned after insertion into the basket. At the periphery of the screen member, the screen frame 7 terminates in a turned back edge to form a hook strip 21. A tension rail 23 is attached to the side wall of the basket 1 by a tension bolt 25. The hook strip 21 is hooked around a part of the tension rail 23 when the screen member is inserted into the basket, and tightening of the tension bolt 25 moves the tension rail outwardly towards the side wall 1 of the basket so as to tension the screen member.

In this embodiment, the basket 1 also has steel support members 27, 29 extending across the screen member. Normally, the screen member will be selected so that portions of the screen frame 7 are opposed to these support members 27, 29, with strips of screen 5 in between.

The lower support members 29 terminate in solid rubber end pieces 31. The upper support members 27 terminate in hollow rubber end pieces which form inflatable members 3.

In order to clamp the screen member in position, the inflatable members 3 are inflated. On inflation, the members 3 expand and press the screen member downwardly against the rubber end pieces 31. In this way, the screen member is held securely between the upper and lower supports 27, 29 of the basket 21.

It should be noted that in FIG. 2, the inflatable members 3 do not only extend alongside the walls of the basket 1 but also extend across the area defined by those walls in positions spaced therefrom.

Figure 3:
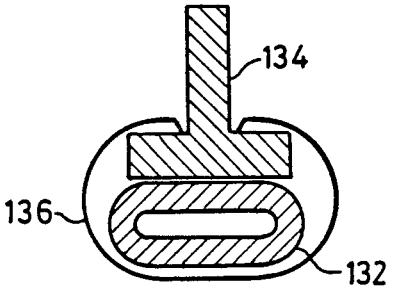
FIG. 3 is an end view of another form of inflatable hose.

FIG. 3 shows a preferred hose design in which a flattened hose 132 having a partially flattened face is attached along a central linear region of its upper surface of the underside of a support member 134 and is held in place by a resilient enclosure member (attaching means) such as a ring or the like 136. The latter may be elastic. A normally flat surface of the resilient enclosure member 136 engages the underside of the hose 132 so as to comprise flattening means. The resilience of the ring 136 may help to deflate and flatten the hose 132 when the inflation fluid is vented.

Figure 4:
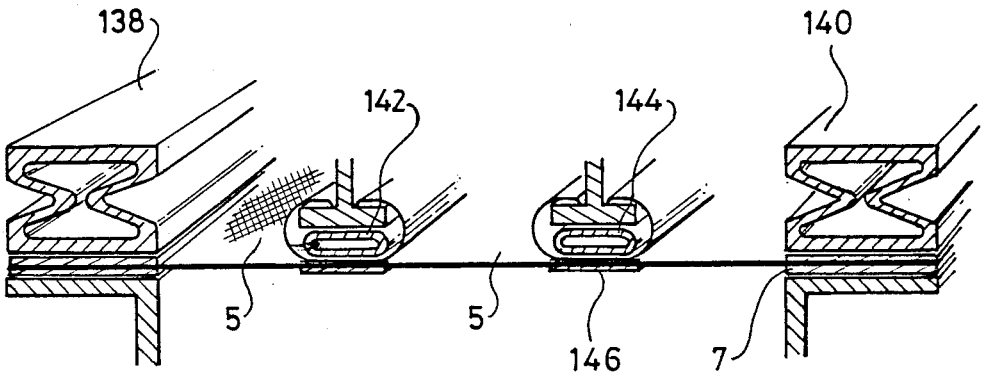
FIG. 4 is an end view of a screen assembly utilising different hose types.

FIG. 4 shows how a combination of two different types of expansible hose can be used to secure a screen in place. The generally square section hoses 138, 140 serve to grip the opposed edge regions of the screen frame and the intermediate hoses 142, 144 are positioned across the width of the screen to engage stiffening ribs or other strengthening means 146, which may be parts of the screen frame 7 located at intervals across the screen.

As will be apparent to those skilled in the art, various modifications and further embodiments are possible.

I claim:

1. Vibratory screening apparatus in which a screen member is mounted, the apparatus comprising:

a vibratory framework including screen member support means, inflatable hose means preformed with at least a partially flattened face, attaching means for attaching said hose means to said vibratory framework with said flattened face on the underside of said attaching means and above said support means, said attaching means including a resilient enclosure member surrounding said hose means for holding said flattened face of the hose means, and means for inflating said hose means to cause said flattened face thereof to move said resilient enclosure member and urge a screen member inserted beneath said hose means downwardly into clamping engagement against said support means, said enclosure member comprises means for flattening said hose means and for aiding in the deflation of said hose means.

2. Vibratory screening apparatus according to claim 1 in which the inflatable hose means overlies a part of a screen member mounted in the apparatus which part is spaced from the periphery of the screen member.

3. Vibratory screen apparatus according to claim 1 wherein said inflating means includes means to deflate said hose means to release a clamped screen member.

4. Vibratory screening apparatus according to claim 3 wherein said inflating means includes a reservoir for inflation fluid exhausted from the inflatable hose means during deflation thereof.

5. Vibratory screening apparatus according to claim 1 wherein said flattening means comprise a normally flat surface of said resilient enclosure member, the normally flat surface engaging the underside of the hose means.

6. A method of clamping a screen member in place in a vibratory screen apparatus including a vibratory framework having a screen member support means, an inflatable hose means preformed with at least a partially flattened face, and attaching means for attaching said hose means to said vibratory framework with said hose surrounded by a resilient enclosure member and said flattened face held by said resilient enclosure member on the underside of said attaching means and above said support means, said method comprising the steps of inserting said screen member between said hose means and said support means, inflating said inflatable hose means when said screen member is so inserted in order to clamp the screen member is position between said flattened face and said support means, and flattening and deflating said inflatable hose means with the aid of said resilient enclosure member.

7. A method according to claim 6 in which the screen member comprises a screen located in a screen frame.

8. A method according to claim 7 in which the screen is tensioned against the screen frame.

9. A method according to claim 8 in which the screen is tensioned against the screen frame before being mounted in the vibratory screening apparatus.

10. A method according to claim 6 in which the screen member is tensioned against the vibratory screening apparatus after it has been mounted in the apparatus.

11. A method according to claim 6 in which the inflatable hose means overlies a part of the screen member when the screen member is in place which part is spaced from the periphery of the screen member.

* * * * *